US009153861B2

(12) United States Patent
Laifenfeld et al.

(10) Patent No.: US 9,153,861 B2
(45) Date of Patent: Oct. 6, 2015

(54) USING A VEHICLE STRUCTURE AS A MEDIUM FOR COMMUNICATION AND POWER DISTRIBUTION

(71) Applicant: GM GLOBAL TECHNOLOGY OPERATIONS LLC, Detroit, MI (US)

(72) Inventors: Moshe Laifenfeld, Haifa (IL); Gill Rafael Tsouri, Rochester, NY (US); Eviatar Tron, Tel Aviv (IL)

(73) Assignee: GM Global Technology Operations LLC, Detroit, MI (US)

( * ) Notice: Subject to any disclaimer, the term of this patent is extended or adjusted under 35 U.S.C. 154(b) by 275 days.

(21) Appl. No.: 13/961,002

(22) Filed: Aug. 7, 2013

(65) Prior Publication Data

US 2015/0042522 A1 Feb. 12, 2015

(51) Int. Cl.
*H01Q 1/32* (2006.01)

(52) U.S. Cl.
CPC ..... *H01Q 1/32* (2013.01)

(58) Field of Classification Search
USPC ..... 343/711, 712, 713
See application file for complete search history.

(56) References Cited

U.S. PATENT DOCUMENTS

| | | | | |
|---|---|---|---|---|
| 4,910,793 | A * | 3/1990 | Mainardi | 455/523 |
| 5,049,892 | A | 9/1991 | Lindenmeier et al. | |
| 6,249,242 | B1 * | 6/2001 | Sekine et al. | 342/70 |
| 6,600,896 | B2 | 7/2003 | Chadwick | |
| 7,111,577 | B1 * | 9/2006 | Bruno | 114/355 |
| 7,289,022 | B2 | 10/2007 | Ogawa | |
| 7,710,251 | B2 | 5/2010 | Talty | |
| 7,791,460 | B2 | 9/2010 | Watabe | |
| 8,270,452 | B2 | 9/2012 | Melick | |
| 8,307,922 | B2 | 11/2012 | Perlman | |
| 8,335,599 | B2 | 12/2012 | Dickerhoof | |
| 2007/0109112 | A1 | 5/2007 | Lee | |
| 2010/0234071 | A1 | 9/2010 | Shabtay | |
| 2012/0134389 | A1 | 5/2012 | Pahlavan | |
| 2012/0200379 | A1 | 8/2012 | Noble | |
| 2012/0242454 | A1 | 9/2012 | Wyler | |
| 2013/0039472 | A1 | 2/2013 | Morton | |
| 2013/0088345 | A1 | 4/2013 | Roesner | |

FOREIGN PATENT DOCUMENTS

| | | |
|---|---|---|
| DE | 20 2011 110 175 U1 | 5/2013 |
| EP | 2 645 474 A1 | 10/2013 |

OTHER PUBLICATIONS

File: Split-ring resonator array 10K sq nm.jpg: https://en.wikipedia.org/wiki/File:Split-ring_resonator_array_10K_sq_nm.jpg. Web. Jul. 29, 2013.

(Continued)

*Primary Examiner* — Tan Ho
(74) *Attorney, Agent, or Firm* — John A. Miller; Miller IP Group, PLC

(57) ABSTRACT

A system and method for using the skin of a vehicle as a waveguide for surface waves to support far-field signal propagation to provide communications between various electrical nodes on the vehicle and for providing power signals. A dielectric layer is formed on the skin to define the waveguide, and a coupler couples signals from the node to the waveguide and receives signals from the waveguide to be sent to the node.

22 Claims, 2 Drawing Sheets

(56) References Cited

OTHER PUBLICATIONS

It's Not Spray Paint, It's a Cellular Antenna: http://www.techhive.com/article/249936/its_not_spray_paint_its_a_cellular_antenna_html Web. Jun. 26, 2013.

Zeng, Hua, The Effect of the Vehicle Body on EM Propatgation in Tire Pressure Monitoring Systems, IEEE Transactions on Antennas and Propagation, pp. 3941-3949, vol. 60, No. 8, Aug. 2012.

Gyroscopic Sensors, IP.com Prior Art Database Technical Disclosures, IP.com No. IPCOM000200877D, IP.com Electronic Publication, pp. 1-15, Oct. 27, 2010.

Zhou, Fang, Development Method of Simulation and Test System for Vehicle Body CAN Bus Based on CANoe, Proceedings of the 7th World Congress on Intelligent Control and Automation, pp. 7515-7519, Jun. 25-27, 2008, Chongqing, China.

IP.com Wireless-Enabled Microphone, Speaker and User Interface for a Vehicle, IP.com No. IPCOM000030782D, IP.com Electronic Publication, pp. 1-5, Aug. 26, 2004.

* cited by examiner

USING A VEHICLE STRUCTURE AS A MEDIUM FOR COMMUNICATION AND POWER DISTRIBUTION

BACKGROUND OF THE INVENTION

1. Field of the Invention

This invention relates generally to a system and method for using a vehicle structure as a waveguide for signal propagation and, more particularly, to a system and method for using a vehicle skin having a dielectric layer thereon as a waveguide for signal propagation for communication and power purposes.

2. Discussion of the Related Art

Modern vehicles employ many sensors, actuators, controllers, sub-systems, buses, etc. that require electrical wiring to provide signals to and receive signals from the various devices to operate the devices. As the number of vehicle systems increases, so does the wiring necessary to support those systems. However, there are a number of disadvantages with providing wires in a vehicle, especially many wires. For example, the electrical conductor of the wires, such as copper, has significant weight. As the weight of a vehicle increases, fuel efficiency decreases. Further, wiring in a vehicle is susceptible to damage, which increases the warranty cost of the vehicle. Also, requiring wiring throughout the vehicle reduces the flexibility in design and manufacturing of the vehicle. Further, at least some of the wiring in a vehicle often requires periodic maintenance. Also, wiring adds significant expense and cost. Further, during manufacture of the vehicle, assembly of cable harnesses often causes problems as a result of breaking or bending of connector pins. Therefore, it would be desirable to eliminate or reduce the wiring in a vehicle.

It is known in the art to employ wireless technology in a vehicle for communications purposes at least in limited circumstances. However, the transmission of wireless signals also suffers from a number of disadvantages including interference with signals from other vehicles, potential interference with signals from consumer devices brought into the vehicle, unnecessary radiation inside the passenger compartment of the vehicle, and fading issues, which result in loss of signal, requiring larger transmitted power and large power consumption.

SUMMARY OF THE INVENTION

In accordance with the teachings of the present invention, a system and method are disclosed for using various vehicle structures, such as the vehicle skin, as a waveguide for high frequency electro-magnetic fields allowing far-field signal propagation to provide communications between various electrical nodes on the vehicle and for providing power signals. A dielectric layer is applied to structure to define the waveguide, and a coupler electro-magnetically couples signals from the node to the waveguide and electro-magnetically receives signals from the waveguide to be sent to the node.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a system and method for using or altering a vehicle structure, such as the vehicle skin, as a waveguide for far-field signal propagation for communications or power purposes is merely exemplary in nature, and is in no way intended to limit the invention or its applications or uses.

As will be discussed in detail below, the present invention proposes using a vehicle structure, such as the inside surface of the skin of a vehicle, as is or altered with one or more dielectric layers as a waveguide or media for electro-magnetic surface wave propagation to support far-field signal propagation to provide communications to and from electrical nodes on the vehicle and for harvesting energy from the waveguide that is then provided to the nodes for power purposes. Electro-magnetic waves have a tendency to propagate along the curvature of obstacles in their path. Thus, a vehicle body can be employed as a leaky ground dielectric waveguide structure that is capable of supporting the propagation of an electro-magnetic signal. Once the waveguide has been established, highly directional transmitting antennas or couplers directed at the vehicle structure can be provided in close proximity to the body to provide a signal path between the node and the waveguide. The desired frequency employed is that frequency where a propagation mode builds up in the body of the vehicle resulting in a waveguide type of propagation.

The dielectric layer can be formed on the vehicle skin in any suitable manner consistent with the discussion herein. Examples include using a suitable paint as a dielectric to create waveguide arteries on the surface of the vehicle by controlling paint thickness and electrical properties to support signal propagation. Another suitable implementation includes using thin and long stickers having the necessary dielectric properties for the particular nodes. Also, layers of paint can be used where each layer has a periodic painted pattern to control reflection and transmission properties of the layers and where all of the layers combine to form an effective waveguide.

Implementation of the invention as discussed herein should provide a number of benefits including a lower transmission power because signal attenuation through the body waveguide would be lower than through air. Further, the implementation may realize very high antenna gains due to coupler efficiency. Also, lower interference could be achieved due to the lower transmission power only nodes that are in very close proximity to the body are affected and there would less external interference from the environment providing more security. Propagation of signals through the waveguide would suffer less from fading caused by movement in the vehicle cabin or mechanical movement in the engine compartment.

Figure 1:
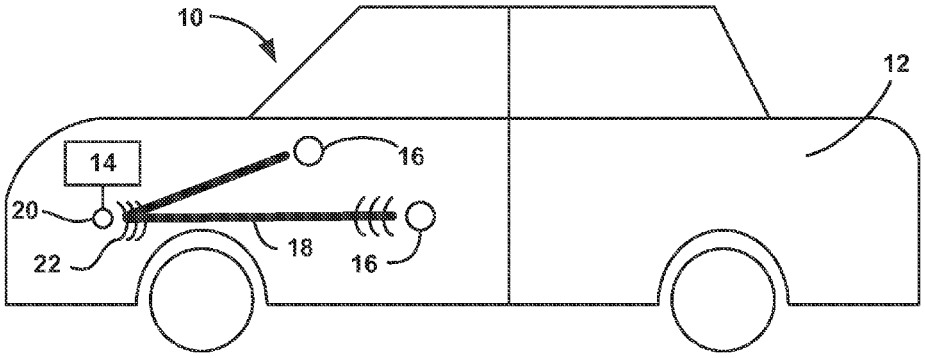
FIG. 1 is an illustration of a vehicle including electrical devices or nodes that are in communication with each other through a waveguide provided by the skin of the vehicle.

FIG. 1 is a simplified side view illustration of a vehicle 10 including an outer vehicle skin 12. Although the discussion herein refers to the vehicle skin 12 as being the foundation for the electro-magnetic waveguide, those skilled in the art will understand that other vehicle structures, such as internal and external trim, beams, chassis, etc., may also be suitable for providing a waveguide for far-field signal propagation. Typically, the skin 12 will be a suitable metal for vehicle manufacturing, such as steel. However, in other vehicle designs, such as for high performance vehicles, the skin 12 may be a polymer or other suitable non-conductive material. As an example, the vehicle 10 may include a body control module (BCM) 14 that provides command and control signals for a number of vehicle sensors, devices, actuators and sub-systems referred generally herein as electrical nodes and represented by reference number 16 possibly defining a network architecture. For example, a node 16 may be a side impact sensor (SIS), window switch, motor, tail-gate lights, etc. Those skilled in the art will readily recognize the various devices and modules that the BCM 14 or other module can control for a particular vehicle. The BCM 14 and the nodes 16 would be located and positioned within the vehicle 10 at certain desirable locations depending on the specific vehicle design. It is noted that the number and type of modules, engine control units (ECU), bus controllers, sensors, devices, actuators, switches, etc. in a particular architecture that may benefit from the waveguide discussed herein would depend on the specific vehicle and application.

As mentioned above, the specific configuration of the dielectric layers can take on many forms to provide a waveguide for the propagation of surface waves on the vehicle skin 12. In one non-limiting design, dielectric layers are formed as arteries on an inside surface of the vehicles skin 12, represented generally here as waveguides 18. A main waveguide could be a signal bus extending around the entire vehicle 10 where the various nodes that use the waveguides in the vehicle 10 for communication purposes would have signal paths that are electrically coupled to the bus. The BCM 14 includes a coupler 20 that provides electro-magnetic signal coupling to the waveguide 18 for transmission of signals to and receipt of signals from the BCM 14, where the signals are represented here as surface waves 22. The nodes 16 may employ multiple-access (MAC) techniques, such as frequency division, time division, code division, etc., to separate and identify the signals. The frequency band employed for the signals can be any frequency suitable for the purposes discussed herein, such as the frequency where the waveguide effect reaches its optimum with minimum energy leaks.

As will be discussed in more detail below, each of the nodes 16 that are part of the communications network that communicate through the waveguides provided by the configuration of dielectric layers and the vehicle skin 12 will include a coupler positioned proximate to the waveguide 18 that is tuned and impedance matched so that signals can be transmitted into the waveguide 18 and be received from the waveguide 18 with minimal losses. Each node 16 will also include a suitable transceiver circuit that generates the electro-magnetic signals for transmission and receive the electro-magnetic signals for reception and may provide analog-to-digital signal conversion and digital-to-analog signal conversion.

Figure 2:
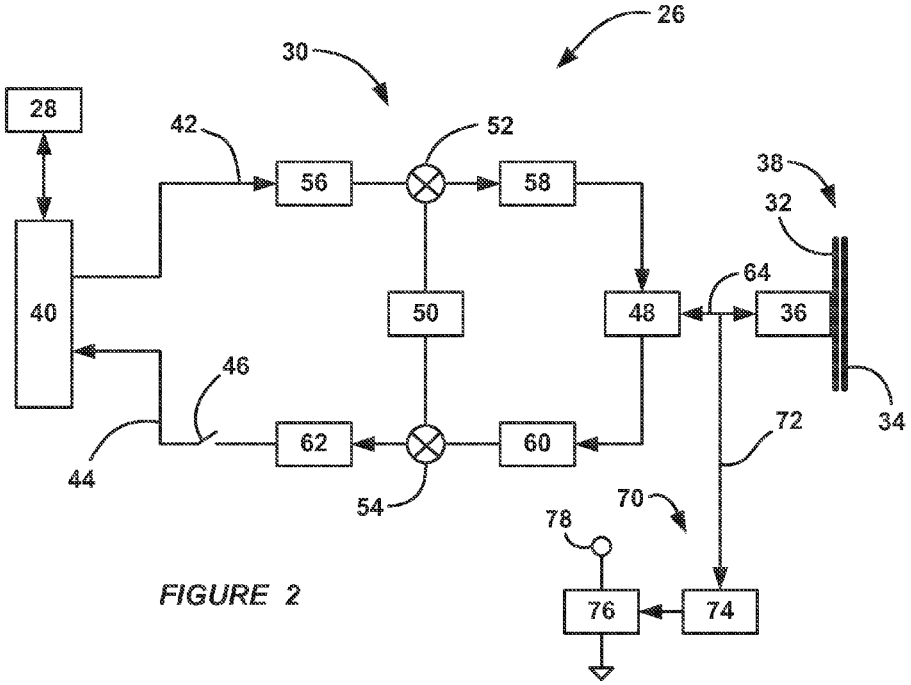
FIG. 2 is a schematic block diagram of a vehicle system including a transceiver electrically coupled to a waveguide on a vehicle skin.

FIG. 2 is a schematic block diagram of a vehicle system 26 including a transceiver 30 for this purpose. It is noted that the transceiver 30 is shown and described by way of a non-limiting example in that those skilled in the art will recognize that many other transceiver circuit designs may be applicable. The vehicle skin 12 is represented as layer 34 in FIG. 2. One or more dielectric layers 32 are deposited on an inside surface of the layer 34 and operate in combination with the layer 34 to provide a waveguide 38 for electromagnetic signal propagation consistent with the discussion herein. The transceiver 30 includes a coupler 36 positioned in close proximity or in contact with the layer 32. The coupler 36 is operable to transmit electro-magnetic signals into the waveguide 38 and receive electro-magnetic signals propagating on the waveguide 38 with low signal loss. The coupler 36 can be any coupler or antenna suitable for the purposes discussed herein, and can employ either capacitive coupling or inductive coupling. In those embodiments where the layer 34 is non-metallic, the waveguide 38 employs the transverse electrical mode to generate the surface waves.

The transceiver 30 includes a microprocessor 40 that receives command signals for data transfer for both transmission and reception purposes from, for example, a controller 28. The microprocessor 40 provides analog signals on line 42 for transmission and receives analog signals on line 44 for reception, where the line 44 includes a switch 46. A transmission/reception switch 48 that is controlled by the microprocessor 40 selects which mode the transceiver 30 is currently being use for. Signals to be transmitted on the line 42 are modulated onto an analog carrier wave by a modulator 56 and up-converted for transmission by a mixer 52 that receives a local oscillator (LO) signal from a local oscillator 50. The up-converted signal for transmission is amplified by an amplifier 58 and then coupled into the waveguide 38 by the coupler 36 from the waveguide 38. Likewise, signals received by the coupler 36 are filtered to the desired frequency band by filter 60 and down-converted by a mixer 54 that also receives the local oscillator signal from the local oscillator 50. The down-converted signal is demodulated by a demodulator 62 and sent to the microprocessor 40 to be converted to digital signals.

Signals to be transmitted are sent from the switch 48 to the coupler 36 on line 64 and signals received by the coupler 36 are sent to the switch 48 on the line 64. The line 64 is intended to represent any signal propagation medium suitable for the purposes discussed herein. In one embodiment, the line 64 can be a galvanic connection provided by wires and in another embodiment, the line 64 can be an RF connection between the switch 48 and the coupler 36. For RF coupling, the skin 34 and the coupler 36 may operate as a passive repeater.

The present invention also proposes harvesting energy from electro-magnetic waves propagating along the waveguide 38. Certain of the devices that are part of the overall communications system may receive power from a vehicle battery (not shown) and as such may be able to provide continuous power as electro-magnetic surface waves into the waveguide 38 to be received by other nodes in the system 26. In this embodiment, if the system 26 is a device that does not receive power from the vehicle battery, then the system 26 may include an energy harvester 70 that receives electro-magnetic energy propagating along the waveguide 38 that is coupled by the coupler 36 to the energy harvester 70 on line 72. The energy harvester 70 includes an RF device 74 that receives the signal on the line 72 and rectifies it to provide DC energy that is stored by a power storage device 76, such as a super-capacitor. The power storage device 76 then provides low power at terminal 78 that can be used to power the various devices in the transceiver 30 and the controller 28. In an alternated embodiment, the storage device 76 can be eliminated where the power is applied directly to the node from the device 74.

The waveguide 38 discussed herein for surface wave propagation over the vehicle skin 12 has properties determined by a number of parameters of the system. Those parameters include the signal frequency being used, the dielectric constant E of the dielectric layer 32, the thickness of the dielectric layer 32, the conductivity of the layer 34, etc. As mentioned above, the vehicle skin 12 can be metallic or non-metallic. Surface wave propagation is provided by the interface of the dielectric layer 32 with another layer, including air. Designers of a specific system will consider all of these parameters to provide the ability to transmit signals into the waveguide 38 and receive signals from the waveguide 38.

The propagation of the surface waves typically are on an interface of the dielectric layer 32 and can include both the interface of the dielectric layer 32 with air and the interface of the dielectric layer 32 with the layer 34. The dielectric layer 32 can be tuned and engineered for a particular application consistent with the discussion herein. The dielectric layer 32 can be a specialized paint that is deposited on the layer 34 in multiple layers and with different dielectric constants E. The energy provided by the electro-magnetic wave propagation decays exponentially the farther from the waveguide 38. Therefore, the thickness of the dielectric layer 32 is selected to consider this exponential decay to increase signal collection. In one design, the thickness of the dielectric layer 32 is selected based on a fraction of the wavelength of the signal being coupled into the waveguide 38 or being received from the waveguide 38. For relatively high dielectric constant materials, the thickness can be reduced accordingly and still obtain the desired signal coupling.

Figure 3:
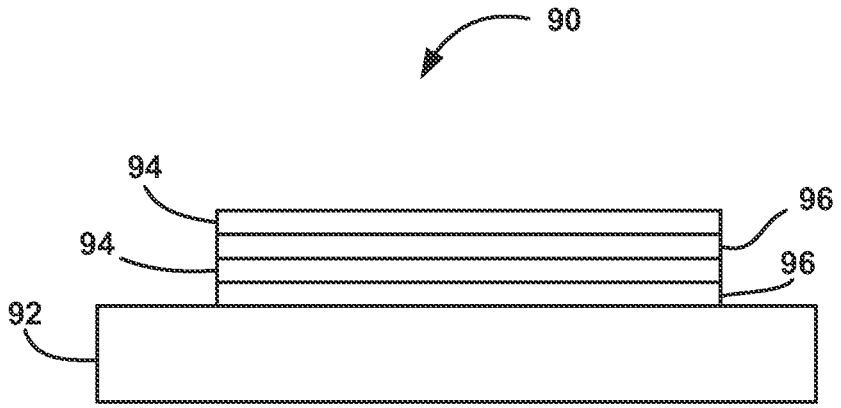
FIG. 3 is a cross-sectional type view showing alternating dielectric layers and conductive layers forming a waveguide on a vehicle skin.

In one embodiment, the waveguide 38 is formed by an alternating sequence of a dielectric layer and a conductive layer. FIG. 3 illustrates this embodiment and shows a waveguide 90 where the vehicle structure is represented by layer 92. An alternating sequence of dielectric layers 94 and conductive layers 96 are deposited on the layer 92. The layers 94 and 96 can be deposited in any suitable manner, such as by spraying, brushing, vapor deposition, electro-coating, adhesive, etc. Although the layers 94 and 96 are shown having the same thickness, this is by way of a non-limiting example in that the layers 94 and 96 could have different thicknesses and different dielectric and conductive properties. Further, the dielectric constant E of the dielectric layers 94 can be different for the different layers 94 and the conductive layers 96 can be made of different conductive materials. Also, the representation of four of the layers 94 and 96 is also by way of a non-limiting example in that the number of layers would also be design and application specific. Further, the layers 94 and 96 are shown as strips on the layer 92, which may not be necessary. Also, the layers 94 and 96 can be meta-materials known to those skilled in the art.

Figure 4:
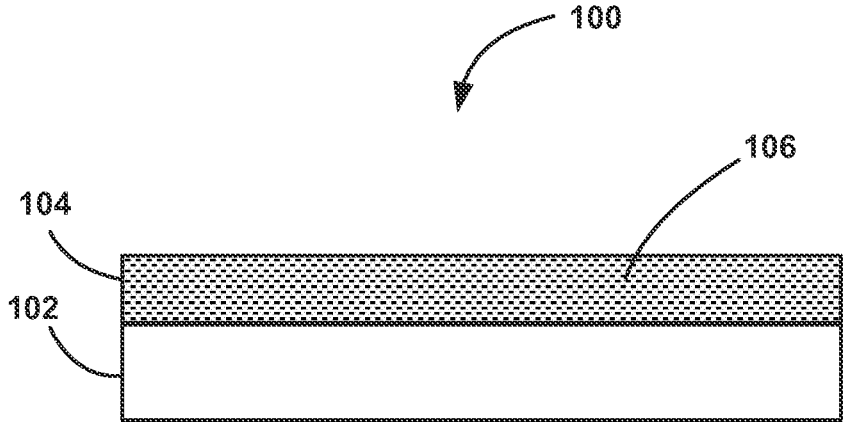
FIG. 4 is a cross-sectional type view showing periodic painted patterns forming a waveguide on a vehicle skin.

In another embodiment, the dielectric layer is formed by a paint including nano-conductors. This embodiment is illustrated in FIG. 4 showing a waveguide 100 where the vehicle skin is represented by layer 102. A dielectric layer 104 is deposited on the layer 102 by any suitable technique, such as spraying, painting, vapor deposition, adhesive, etc. The layer 104 includes a configuration of nano-conductors 106 that combine with the layer 102 to form the waveguide 100. As above, the thickness of the layer 104 would be application and design specific. Also, more than one layer can be deposited having different conductive properties.

As will be well understood by those skilled in the art, the several and various steps and processes that may be discussed herein to describe the invention may be referring to operations performed by a computer, a processor or other electronic calculating device that manipulate and/or transform data using electrical phenomenon. Those computers and electronic devices may employ various volatile and/or non-volatile memories including non-transitory computer-readable medium with an executable program stored thereon including various code or executable instructions able to be performed by the computer or processor, where the memory and/or computer-readable medium may include all forms and types of memory and other computer-readable media.

The foregoing discussion disclosed and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A vehicle communications system comprising:

a vehicle structure having a surface;

a waveguide formed on the surface of the vehicle structure, said waveguide including at least one dielectric layer;

a coupler positioned proximate to the at least one dielectric layer; and a device node electrically coupled to the coupler, said device node including a transceiver, said transceiver coupling electro-magnetic signals into the waveguide through the coupler and receiving electro-magnetic signals from the waveguide through the coupler.

2. The system according to claim 1 where the coupler is inductively coupled to the waveguide.

3. The system according to claim 1 wherein the coupler is capacitively coupled to the waveguide.

4. The system according to claim 1 wherein the vehicle structure is a vehicle skin, said waveguide being formed on an inner surface of the vehicle skin.

5. The system according to claim 4 wherein the vehicle skin is metallic.

6. The system according to claim 4 wherein the vehicle skin is non-metallic.

7. The system according to claim 1 wherein the device node is galvanically coupled to the coupler.

8. The system according to claim 1 wherein the device node is RF coupled to the coupler.

9. The system according to claim 1 wherein the device node is selected from the group consisting of a sensor, switch, actuator and bus controller.

10. The system according to claim 1 wherein the device node is an electronic control unit.

11. The system according to claim 1 wherein the at least one dielectric layer is a plurality of dielectric layers.

12. The system according to claim 1 wherein the waveguide includes an alternating pattern of dielectric layers and conductive layers.

13. The system according to claim 1 wherein the waveguide includes a periodic pattern of dielectric layers.

14. The system according to claim 1 wherein the at least one dielectric layer is paint.

15. The system according to claim 1 wherein the at least one dielectric layer is a meta-material.

16. The system according to claim 1 wherein the at least one dielectric layer is a dielectric paint including nano-conductors.

17. The system according to claim 1 wherein the waveguide is formed as a strip on the surface of the vehicle structure.

18. The system according to claim 1 further comprising an energy harvester receiving energy from electro-magnetic signals propagating on the waveguide and provided to the energy harvester through the coupler.

19. The system according to claim 18 wherein the energy harvester provides power to the device node.

20. A vehicle communications system comprising:

a waveguide defined by a vehicle skin and at least one dielectric layer deposited on the vehicle skin;

a coupler positioned proximate to the waveguide; and a device node electrically coupled to the coupler, said device node coupling electro-magnetic signals into the waveguide through the coupler and receiving electro-magnetic signals from the waveguide through the coupler.

21. The system according to claim 20 further comprising an energy harvester receiving and storing energy from electro-magnetic signals propagating on the waveguide and provided to the energy harvester through the coupler.

22. The system according to claim 20 wherein the at least one dielectric layer is paint.

* * * * *